US005160089A

United States Patent [19]

Radtke et al.

[11] Patent Number: 5,160,089

[45] Date of Patent: Nov. 3, 1992

[54] SHEET-STAPLING DEVICE

[75] Inventors: Manfred Radtke, Korb; Juergen Ries, Nellingen, both of Fed. Rep. of Germany

[73] Assignee: Eastman Kodak Company, Rochester, N.Y.

[21] Appl. No.: 797,623

[22] Filed: Nov. 25, 1991

[30] Foreign Application Priority Data

Jan. 18, 1991 [DE] Fed. Rep. of Germany ..... 4101391

[51] Int. Cl.[5] ..... B42B 2/00

[52] U.S. Cl. ..... 227/111; 227/78; 227/110

[58] Field of Search ..... 227/78, 101, 110, 111; 83/498, 504; 270/53, 37

[56] References Cited

U.S. PATENT DOCUMENTS 481,747 8/1892 Burnet ..... 227/101
2,730,142 1/1956 Berberich ..... 270/53 X
4,441,643 4/1984 McCutchen ..... 227/110

FOREIGN PATENT DOCUMENTS 0012737 6/1980 European Pat. Off. ..... 227/78

*Primary Examiner*—Douglas D. Watts
*Assistant Examiner*—Rinaldi Rada
*Attorney, Agent, or Firm*—Lawrence P. Kessler

[57] ABSTRACT

In the case of a stapling device having a stapling head 1 which is mounted so as to be shifted along an adjustment rod 5 for adaptation to different sheet formats, the adjustment rod 5 has more than one row 23, 24 of locking elements 17 and 18, respectively, which extend in the direction of adjustment and in which the stapling head 1 can be releasably locked in order to position the stapling head in selected positions for the stapling of different sheet formats. The locking elements 17, 18 of each row 23 and 24, respectively, are arranged according to a sheet format system associated with each row of locking elements.

8 Claims, 4 Drawing Sheets

SHEET-STAPLING DEVICE

BACKGROUND OF THE INVENTION

The invention relates, in general, to sheet-stapling devices and, more particularly, to a sheet-stapling device with at least one stapling head which is arranged so as to be shiftable in an adjusting direction along an elongate adjustment member for adaptation to different sheet formats, and with locking elements which are provided on the adjustment member and on the stapling head and cooperate with each other, such elements being adapted to releasably lock the stapling head in selected positions on the adjustment member and being arranged on the adjustment member in a row extending along the adjusting directicn of the stapling head.

Stapling devices of the general type are known and are frequently used in sheet-handling apparatus provided downstream of sheet output stations of copiers, printers or the like. Sheet-handling apparatus which can be operated together with copiers and which not only comprise a stapling device but also device for collating copy sheets and for forming sheet stacks are also called finishers. When changing the format of the stacked sheets which are to be stapled by means of the stapling device of a sheet-handling apparatus, the shiftable stapling head is moved into the operative position. It is generally required that the operator release the locking engagement of the stapling head and an adjustment member, and then shift the stapling head along the adjustment member until its new operative position is reached. The head can then be locked again on the adjustment member by means of a selected locking element of the row of locking elements.

SUMMARY OF THE INVENTION

This invention is directed to a stapling device of the generic type which can be easily operated. In a stapling device of the type mentioned above, in accordance with the invention, more than one row of locking elements is provided on the adjustment member and extends in the adjusting direction, the rows of locking elements on the adjustment member being offset relative to each other in a direction extending transversely to the adjusting direction. An actuating element is provided which causes the locking elements of the adjustment member and of the stapling head to carry out a relative movement transversely to the adjusting direction and thus align the locking elements of the stapling head with a desired row of the locking elements on the adjustment member.

Due to the fact that, in accordance with the invention more than one row of locking elements is provided on the adjustment member, it is possible to associate a specific row of locking elements with a specific sheet format. One row of locking elements could, for example, be provided for DIN format and another row of locking element for US formats (inch system). In that case, the locking elements of the DIN row would be spaced in accordance with the DIN format, and the locking elements of the other row would be spaced in accordance with the inch system.

Depending upon the sheet format system to be used, the locking elements of the stapling head are aligned with the selected row of locking elements on the adjustment member. When the elements are in alignment, the sheet format can be changed within one system without the operator having to take care that the locking elements have not inadvertently been aligned with the other sheet format system not desired. The operator can be sure that locking is only possible in one operative position of the desired, i.e. "right", format system. When shifting the stapling head of known stapling devices, the operator has to take specific care that locking elements which are arranged in the only existing row and which correspond to a sheet format system not desired are skipped or left out.

Advantageously, the actuating element is designed such that is cooperates with the adjustment member in order to selectively move the member or the row of locking elements provided thereon transversely to the adjusting direction such that a desired row of locking elements is aligned with the locking elements on the stapling head. In the case of a preferred embodiment, the adjustment member is designed as a rotatable rod which comprises on its circumference the rows of locking elements extending in the longitudinal direction of the rod and parallel to each other and which is selectively rotatable by means of the actuating element in order to render operative the row of locking elements, which is desired in the case concerned.

In a particularly advantageous modification of the invention, the arrangement is such that when the actuating element is actuated for the changing over from one row of locking elements to the other, the stapling head and the adjustment member are unlocked. If the row of locking elements on the adjustment member is formed by a row of indentations provided for locking engagement with a spring-biased locking pin on the stapling head, the boundary flanks of the indentation which the engaging locking pin contacts during its relative movement caused by actuation of the actuating element, may have a shape which causes the driving pin to move out of the indentation in opposition to its spring load in order to thus automatically disengage the stapling head and the adjustment member.

The invention, and its objects and advantages, will become more apparent in the detailed description of the preferred embodiment presented below.

BRIEF DESCRIPTION OF THE DRAWINGS

The invention will now be explained in detail with reference to an embodiment illustrated in the drawing where.

DESCRIPTION OF THE PREFERRED EMBODIMENT

Figure 1:
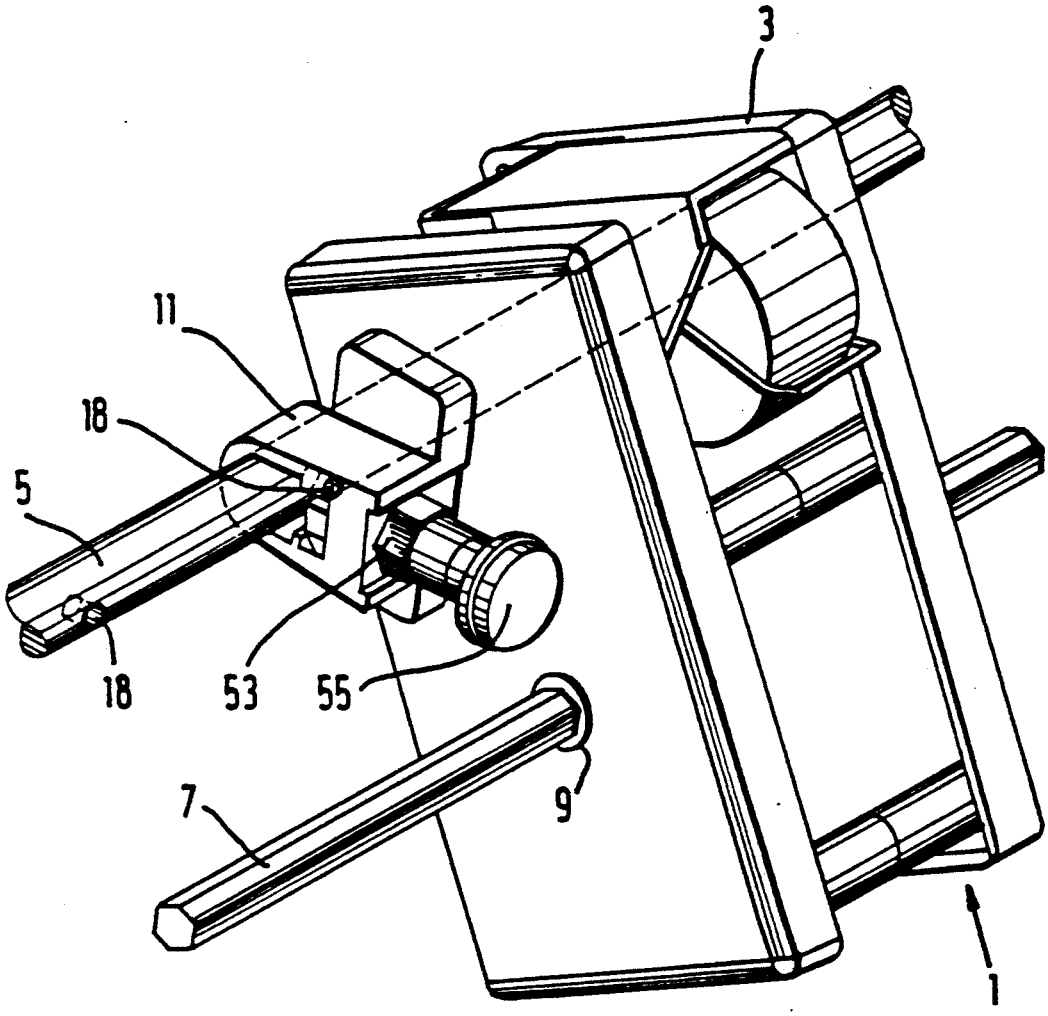
FIG. 1 shows a perspective view of a stapling head which is shiftable along a bar-shaped adjustment member and can be releasably locked with that member in selected positions.

A stapling head denoted 1 in FIG. 1 forms a unit with a housing accommodating such head. The unit is shiftably guided along a guideway for changing its position. The guideway consists of a round adjustment member (or rod) 5 and a guide rod 7 extending at a distance therefrom and parallel thereto. The guide rod 7 is designed as a hexagonal bar which extends through a complementary hexagonal hole in a rotary coupling portion 9 on housing 3 of stapling head 1. The guide rod 7 can thus be used via the coupling portion 9 as a driving shaft for mechanically actuating the stapling head 1 in housing 3. Instead of actuating stapling head 1 mechanically via an external rotary drive (not illustrated) for guide rod 7, a stapling head 1 could be used having an electromagnetic or electromotive drive of its own. Stapling heads serving the purpose described are known to have various elements which are not herein explained in detail.

The shiftable unit consisting of housing 3 and its stapling head 1 can be releasably locked in selectable positions on the adjustment rod 5 by means of a locking device. For that purpose, a lateral attachment 11 is mounted to the housing 3. In that attachment, a locking pin 13 (see in particular FIG. 2) is arranged such that its longitudinal axis 15 (FIG. 2) extends radially with respect to the axis of the adjustment rod 5. Pin 13 is provided for engagement with one or several indentations 17 or 18 which are recessed into the circumference of the adjustment rod 5 and arranged, such that by engagement of pin 13, the stapling head 1 is aligned with positions in which it cooperates with an anvil selected from a number of anvils (not shown) which are arranged in positions corresponding to the individual sheet formats so that the sheet to be stapled come to rest between the anvil and the stapling head 1. This type of locking and the way in which the indentations 17 and 18 are designed and arranged will be described in detail with references to FIGS. 2 to 6.

Figure 2:
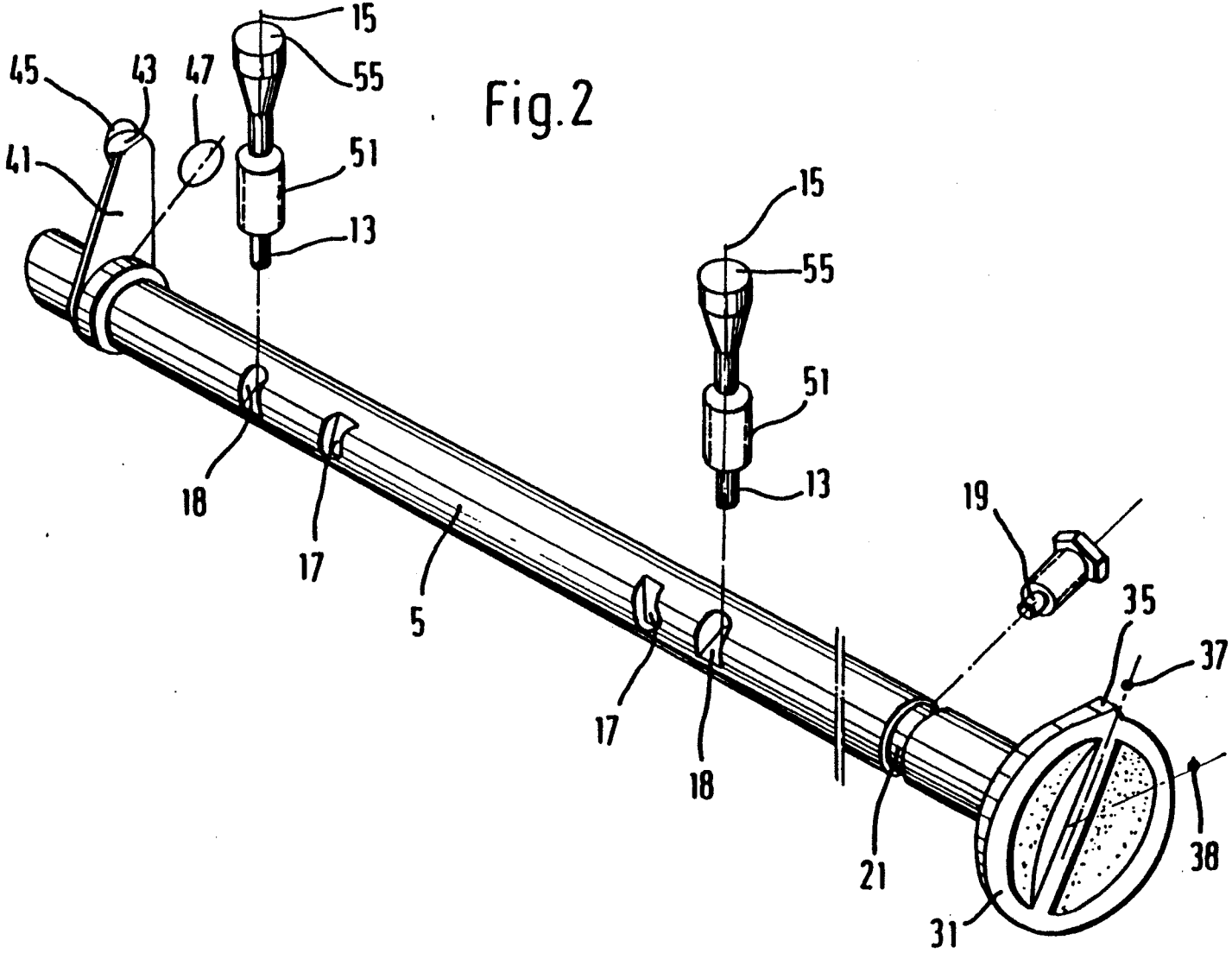
FIG. 2 shows a perspective view of the bar-shaped adjustment member and a few elements of the device cooperating therewith.

Apart from the shiftable stapling head 1 shown in FIG. 1, another stapling head (not illustrated) is provided on the adjustment rod 5 and the guide rod 7, such other stapling head being aligned in a fixed relationship with the one sheet edge of the sheets to be handled and is secured in that position by a safety bolt 19 which is shown in FIG. 2 only and which engages with a circumferential angular groove 21 recessed into the circumference of the adjustment rod 5. Like the shiftable stapling head 1, this fixedly arranged stapling head can also be driven by a rotary movement of the guide rod 7 if, in the case of the embodiment of the stapling device concerned, simultaneous actuation of both stapling heads is desired. It would be possible for the one or the other of the two stapling heads to be driven by an electromotive or electromagnetic drive of its own instead of being rotated by the guide rod 7. In such a case, the coupling portion 9 on housing 3 of stapling head 1 would not be connected with the mechanism thereof.

Figure 3:
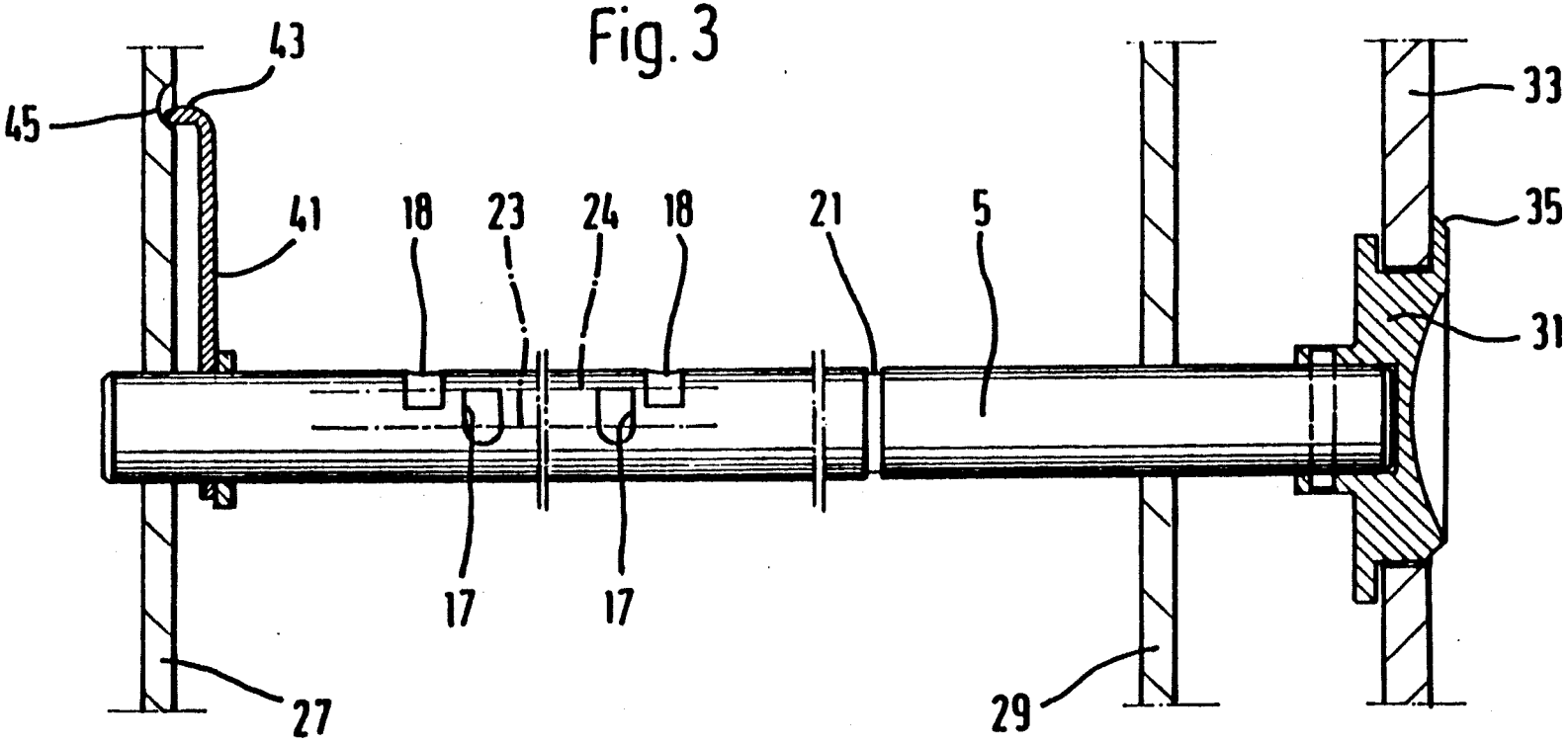
FIG. 3 shows a longitudinal sectional view of the bar-shaped adjustment member mounted in the housing of the stapling device, with parts broken away.
Figure 4:
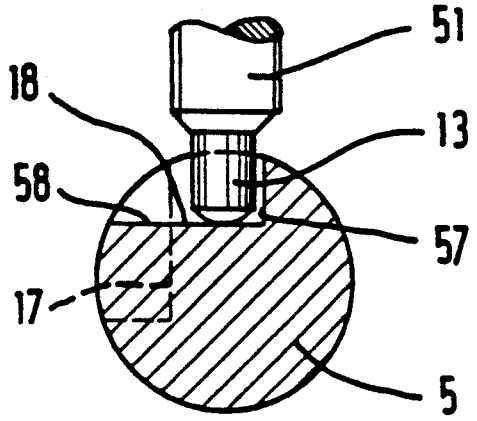
FIGS. 4–6 show cross-sectional views of the bar-shaped adjustment member with the indentations, the adjustment member being shown in various rotary positions and in cooperation with a locking pin.
Figure 5:
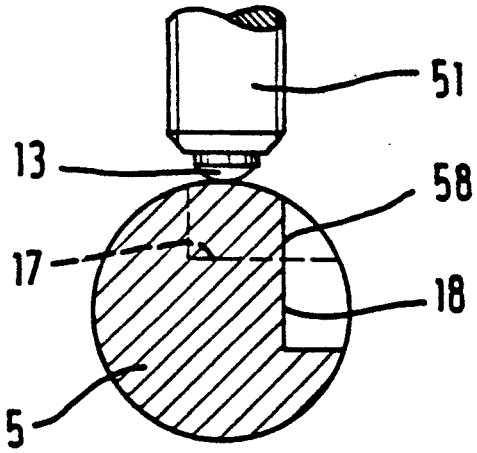
Figure 6:
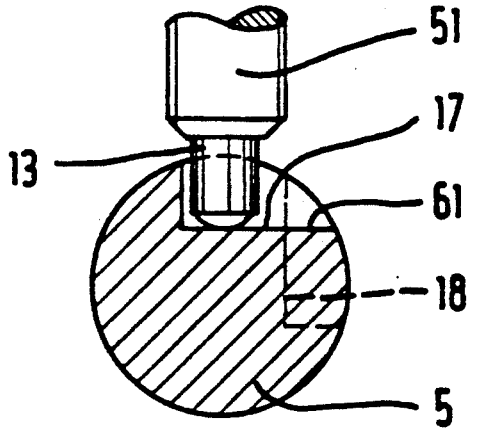

As can be seen in particular from FIG. 3, the indentations 17 and 18 are arranged in rows 23 and 24, respectively, which extend in the longitudinal direction of the adjustment rod 5 and thus in the direction of adjustment of the stapling head 1. Row 23 includes the indentations 17 while row 24 with its indentations 18 is arranged transversely to the adjusting direction of the stapling head 1 and is displaced relative to row 23. To be more precise, it is displaced relative to row 23 on the circumference of the round adjustment rod 5 by an angle of rotation which amounts to 90° as can be seen in FIGS. 4 to 6. Each of the two rows of indentations 17 and 18, respectively, is associated with a sheet format system. In the case of the embodiment, row 23 with its indentations 17 corresponds to the DIN system whereas the other row 24 with it indentations 18 corresponds to the US format system. In the case of the embodiment, for example, indentation 17 which is shown in FIGS. 2 and 3 on the right is spaced from the sheet edge by a distance which correspond to the A-4 format whereas indentations 17, which is positioned further to the left, is spaced by a distance corresponding to the A-3 format. As far as the indentations 18 of the other row 24 are concerned, indentation 18, which is shown in the FIGS., is spaced from the sheet edge on the right by a distance corresponding to the $8\frac{1}{2} \times 11$ inch format, whereas indentation 18 further to the left corresponds to the $11 \times 17$ inch format.

As shown in FIG. 3, the adjustment rod 5 is rotatably mounted in walls 27 and 29 of the device and comprises, at its end adjacent to all 29, a knob 31 attached thereto. Knob 31, which can be manually rotated, is accessible from the outside through an opening in an outside housing wall 33. The knob is provided at its circumference with a projection in the form of a pointer 35 which, depending on the rotary position of the adjustment rod 5, can be aligned with marks 37 or 38 (see FIG. 2) which are visible on the outside of housing wall 33. In order to releasably secure the adjustment rod 5 in the two rotary positions where pointer 35 point to either mark 37 or to mark 38, a leaf spring 41 is attached to the end side of the adjustment rod 5 facing away from knob 31. The leaf spring 41 extends away from rod 5 in the radial direction with its radially outer end section being bent off at about right angles and forming a nose 43 adapted for engagement with one of two notches 45 or 47 which, as can only be seen in FIG. 3, are formed in the surface of the adjacent wall 27 facing the nose. When the adjustment rod 5 is in its rotary position shown in FIG. 2 where pointer 35 of knob 31 points to mark 37, nose 43 engages with notch 45. When knob 31 is rotated in order to leave that position and to align pointer 35 with mark 38, nose 43 disengages notch 45 in opposition to the force of leaf spring 41 and after the following rotary movement engages notch 47.

Locking pin 13 is shiftably guided in a sleeve 51 in the attachment 11 of housing 3. Sleeve 51 is firmly connected with attachment 11 by a screw (of which only a nut 53 is shown in FIG. 1) and forms a housing for an internal screw spring (not shown) which surrounds locking pin 13 and cooperates with the pin such that it is spring-urged to carry out a shifting movement toward the adjustment rod 5. When shifting the housing 3 with stapling head 1 into a position in which one of the indentations 17 or 18 is aligned with locking pin 13, the pin engages into indentation 17 or 18 due to it spring-urging. Locking pin 13 is enlarged at its outer end to form an actuating element 55 by which locking pin 13 can be manually retracted in opposition to the spring urging.

FIG. 2 shows the adjustment rod in a rotary position (pointer 35 of knob 31 pointing to mark 37) in which the row 24 with the indentations 18 is aligned with the plane of movement in which locking pin 13 carries out its movement in the adjusting direction. FIG. 2 shows the locking pin 13 in two positions of which the one to he right in the drawing corresponds to the A-4 and that to the left to the A-3 setting of the stapling head 1. FIG. 4 shows in detail how locking pin 13 engages with indentation 18, and the indentation is designed. As can also be seen from the FIG., indentation 18 has a closed flank 57 and an flank 58. When the adjustment rod 5 is rotated from its position shown in FIG. 4 to its position shown in FIG. 5 and pointer 35 of knob 31 moves from mark 37 to mark 38, locking pin 13 shifts along the open flank 58 of indentation 18. During this operation, flank 58 forms a ramp or cam surface which urges locking pin 13 out of indentation 18 in opposition to its spring urging. The locking engagement is thus released, i.e., locking pin 13 is no longer prevented from shifting in the direction of adjustment (along the adjustment rod 5) as was true before when the locking pin 13 cooperated with the parallel side wall of indentation 18.

When the adjustment rod is in its rotary position according to FIG. 5, row 23 with the indentations 17 is aligned with the plane of movement of locking pin 13 so that said pin engages with an indentation 17 after having moved in the adjusting direction. This operational condition is shown in FIG. 6 where pointer 35 of knob 31 is aligned with mark 38. When the adjustment rod 5 is rotated back counter-clockwise in order to align row 24 of indentation 18 with the plane of movement of locking pin 13, an open flank 61 of indentation 17, whose shape is the mirror image of indentations 18, again forms a cam surface or abutment ramp for locking pin 13 in order to urge that pin out of engagement and to release the locking.

When operating the device, the operator need only select one of rows 23 and 24 or indentations 17 and 18, respectively, by rotating adjustment rod 5, this rotation at the same time neutralizing a given engagement of locking pin 13 and a corresponding indentation 17 or 18. Housing 3 and stapling head 1 are then shifted into the desired position where locking pin 13 automatically engages with indentations 17 and 18 of the row of the desired sheet format system.

The above description and the drawings are confined to features which are essential to the invention. Those features which are disclosed in the description and in the drawing but are not mentioned in the claims also serve for defining the subject matter of the invention, if required.

We claim:

1. Sheet-stapling device comprising: an elongate adjustment member; at least one stapling head (1) supported on said adjustment member (5) so as to be shiftable in an adjusting direction along said adjustment member (5) for adaptation to different sheet formats; locking elements (17, 18, 13) respectively provided on said adjustment member (5) and on said stapling head (1) to cooperate with each other for releasably locking said stapling head in selected position on said adjustment member (5), said locking elements on said adjustment member (5) being arranged in more than one row (23, 24) respectively extending in the adjusting direction, said rows (23 and 24) being offset relative to each other in a direction extending transversely to the adjusting direction; and an actuating element (31) for relatively moving said locking elements (17, 18 and 13, respectively) of said adjustment member (5) and said stapling head (1) transversely to the adjusting direction and thus align said locking elements (13) of said stapling head with a desired one row (23 or 24) of said locking element (17, 18) on said adjustment member (5).

2. Sheet-stapling device according to claim 1 wherein said actuating element (31) cooperates with said adjustment member (5) to move said rows (23 or 24) of locking element (17, 18) provided on said adjustment member transversely to the adjusting direction of said stapling head (1) so as to selectively align one of said rows with said locking elements (13) of said stapling head.

3. Sheet-stapling device according to claim 2 wherein said adjustment member is a rod (5) supported for rotation about its longitudinal axis, said rod (5) defining on it circumference said rows (23 and 24) of adjustment member locking elements (17 and 18, respectively), said rows extending in the longitudinal direction of said rod parallel with each other, and wherein said actuating element is a rotating device (31) for selectively rotating said rod (5).

4. Sheet-stapling device according to claim 3 wherein said adjustment member locking elements defined on said rod (5) include indentations (17, 18) recessed into the circumference of said rod, and said locking elements of said stapling head (1) comprise a locking pin (13), said locking pin being guided for movement at least substantially radially with respect to the longitudinal axis of said rod (5) for engagement with said indentations (17, 18) and for disengagement from said indentations.

5. Sheet-stapling device according to claim 4 wherein said locking pin (13) is spring-urged in the direction toward said indentations (17, 18), and at least one of the boundary flanks (58 and 61) defined by said indentations (18 and 17, respectively) which leads or trails during a rotary movement of said rod (5) has a shape causing said locking pin (13) which comes to rest on said boundary flank (58 or 61) during rotary movement of said rod (5) to be urged out of engagement with such indentation (17 and 18) in opposition to its spring urging.

6. Sheet-stapling device according to claim 5 wherein said actuating element releasably locks said rotatable rod (5) in selected rotary positions, said rotary positions corresponding to the alignment of a desired row (23 or 24) of said indentations (17 and 18, respectively) with the path of movement of said locking pin (13) during adjusting movement of stapling head (1).

7. Sheet-stapling device according to claim 6 wherein said actuating element comprises a knob (31), said knob (31) mounted on said rotatable rod and serving to enable manual positioning of said rod (5).

8. Sheet-stapling device according to claim 1 further comprising a rotary drive means for shifting said stapling head (1) in an adjusting direction along said adjustment member (5) for adaptation to different sheet formats, said rotary drive means including a driving shaft (7) extending in the adjusting direction of said adjustment member (5), and said stapling head (1) including a coupling portion (9) which is axially shiftable on said driving shaft (7) and is guided relative therewith in a non-rotatable manner.

* * * * *